United States Patent [19]

Manera

[11] Patent Number: 5,027,879

[45] Date of Patent: Jul. 2, 1991

[54] DEVICE TO PARK STARTER BARS

[75] Inventor: Roberto Manera, Vogogna, Italy

[73] Assignee: Danieli & C. Officine Meccaniche SpA, Udine, Italy

[21] Appl. No.: 501,541

[22] Filed: Mar. 30, 1990

[30] Foreign Application Priority Data

Apr. 10, 1989 [IT] Italy ..... 83373 A/89

[51] Int. Cl.[5] ..... B22D 11/08

[52] U.S. Cl. ..... 164/426; 164/446

[58] Field of Search ..... 164/425, 426, 445, 446, 164/483, 420

[56] References Cited

U.S. PATENT DOCUMENTS

| | | | |
|---|---|---|---|
| 3,520,351 | 7/1970 | Rankin | 164/426 |
| 4,195,684 | 4/1980 | Tsuchida | 164/420 |
| 4,562,876 | 1/1986 | Hargassner | 164/420 |

FOREIGN PATENT DOCUMENTS

| | | | |
|---|---|---|---|
| 969019 | 4/1958 | Fed. Rep. of Germany | 164/420 |
| 1086015 | 7/1960 | Fed. Rep. of Germany | 164/420 |
| 1483639 | 3/1969 | Fed. Rep. of Germany . | |
| 1423857 | 11/1965 | France . | |
| 2431892 | 2/1980 | France . | |
| 60-9557 | 1/1985 | Japan . | |

*Primary Examiner*—Richard K. Seidel
*Assistant Examiner*—Rex E. Pelto
*Attorney, Agent, or Firm*—Antonelli, Terry, Stout & Kraus

[57] ABSTRACT

Device (10) to park starter bars employed in continuous casting plants, which is able to take at least one starter bar coming from a casting line and to draw and position at least one starter bar towards a casting line and comprises a revolver-type drum (13), which can rotate about a pivot shaft (29) and contains within itself at least one chamber (18–25) to lodge starter bars belonging to at least two types of starter bar, the device (10) comprising also first means (12–30) able to impart rotation to the drum (13) and second means (26) able to cooperate with a temporary pre-set position of standstill of the drum (13) and at the same time to impart to that at least one starter bar a movement into or out from the at least one chamber (18–25).

8 Claims, 4 Drawing Sheets

DEVICE TO PARK STARTER BARS

This invention concerns a device to park starter bars.

To be more exact, the invention concerns a revolver-type device able to lodge and deliver a plurality of starter bars even having different dimensions or belonging to different types to a plurality of continuous casting lines.

The invention is mainly applied to the iron and steel industry.

In the state of the continuous casting art the molten metal is conveyed in a ladle on wheels or carried by a crane to an ingot mold of a suitable shape having an open bottom and positioned above a casting line.

The mold receives the molten metal from the ladle through a pre-heated tundish and discharges it below through the open bottom in a partly solidified continuous flow of a predetermined section; this flow solidifies little by little on the casting line with the help of suitable cooling means located in the initial part of the casting line.

Before the casting is started, it is necessary to shut the open bottom of the mold momentarily so as to prevent a disorderly outflow of the metal.

The open bottom of the mold is shut by means of a starter bar which is inserted by an assembly of drawing rollers into the open bottom of the mold; any gap between the starter bar and the open bottom of the mold is sealed with suitable refractory material.

The first part of the metal teemed into the closed mold is allowed to solidify partly so as to become united to the head of the starter bar.

Thereafter, when the mold has been filled and been oscillated to prevent the formation of a metallic skin on its inner walls, drawing rollers are actuated and arrange to draw the starter bar and to withdraw from the mold the billet connected to the end of the starter bar.

The starter bar is detached thereafter from the billet and is parked at a suitable position near the withdrawal assembly and discharge line, along which the cast product continues travelling for the subsequent rolling operations.

The starter bar, now having a new head, is withdrawn again from its parked position at the start of the next casting operation and follows the above procedure for the beginning of a new billet.

Known starter bars belong substantially to three types: rigid starter bars of an arcuate shape, semi-rigid starter bars having an arcuate shape and consisting of a number of articulated segments and flexible starter bars that comprise a chain.

FR-A-1.423.857 discloses a starter bar parking device consisting of a rotary drum fitted to a stationary frame and located above the conveyor which carries the billet from the casting plant. In this case the starter bar, which consists of an assembly of rigid elements connected together, is wound about the drum after having been taken from a stationary arcuate structure located immediately downstream of the withdrawal and straightening assembly.

The devices of the above type entail many shortcomings and drawbacks. In fact, as they are suitable to lodge one single starter bar of an articulated type, their maintenance and replacement are difficult and lead to downtimes and interruptions of working. Moreover, they can normally serve only one casting line.

This invention has the purpose of obviating the drawbacks and shortcomings of the state of the art and therefore providing a starter bar parkig device which can serve a plurality of casting lines at one and the same time, enables various types of starter bars to be arranged and used to suit the working requirements and can also be employed in cooperation with practically any type of continuous casting plant.

This purpose is achieved by means of a starter bar parking device having the features described in the main claim, while the dependent claims set forth preferred embodiments of the invention.

The device according to the invention comprises a revolver-type drum able to rotate about a pivot shaft substantially parallel to the direction of the insertion of the starter bar into the drum.

A plurality of chambers, each of which can lodge a starter bar, is arranged within the drum.

An accurate lay-out of these chambers about the inner periphery of the revolver drum enables single chambers, or pairs of chambers, or rows of three aligned chambers, to be provided which are suitable to serve one, two or three casting lines respectively belonging to the same plant.

According to the invention a plurality of series of chambers can be included within the drum, each series being intended to be positioned in alignment with the casting lines according to the circumferential position taken up by the drum.

Owing to the invention it is therefore possible to provide for the arrangement of different types of starter bars, which can be moved swiftly by a simple, controlled rotation of the drum from their parked position to their working position in cooperation with the casting lines.

The drum according to the invention can be applied to plants with a curved, horizontal, almost horizontal or vertical casting line at a raised position tilted towards the casting line or aligned with the line at its lower end and horizontal, for instance, where the cast billets or blooms are discharged sideways.

Other advantages of the invention will become clear on reading the following description of an embodiment of the invention given as a non-restrictive example, together with the help of the attached figures, in which :

FIG. 1 gives a side view of a vertical continuous casting plant equipped with a parking device according to the invention;

Figure 4:
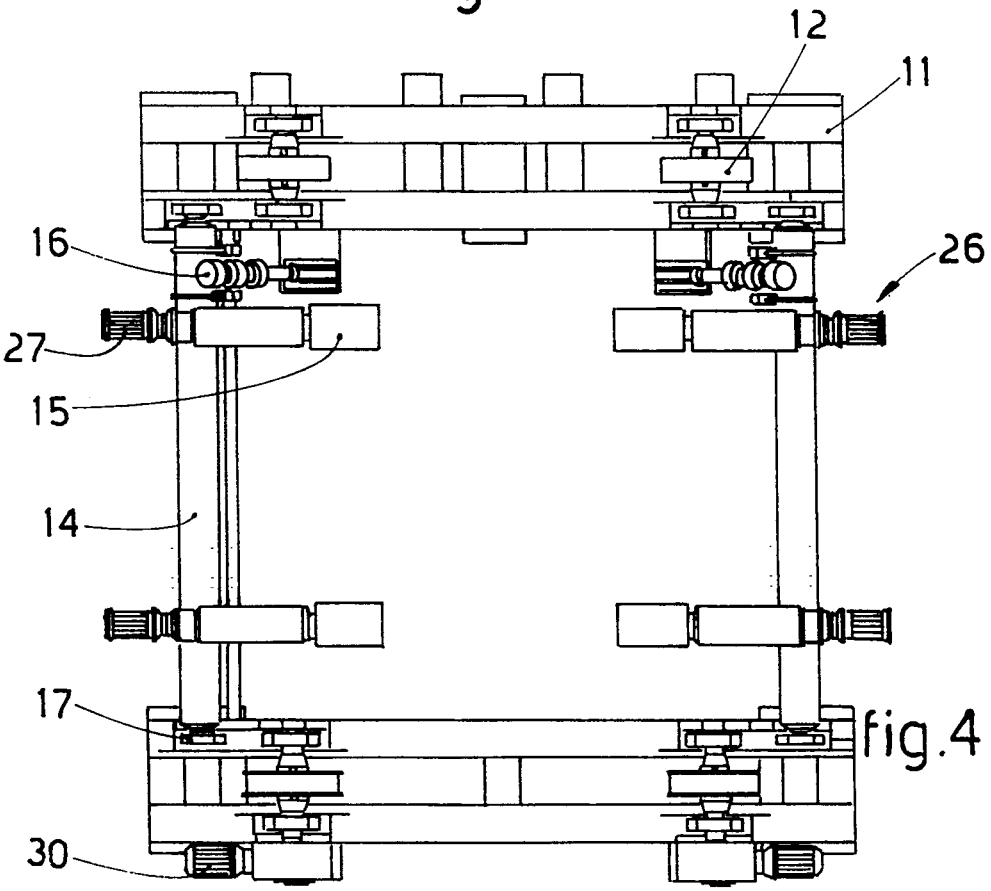
Figure 5:
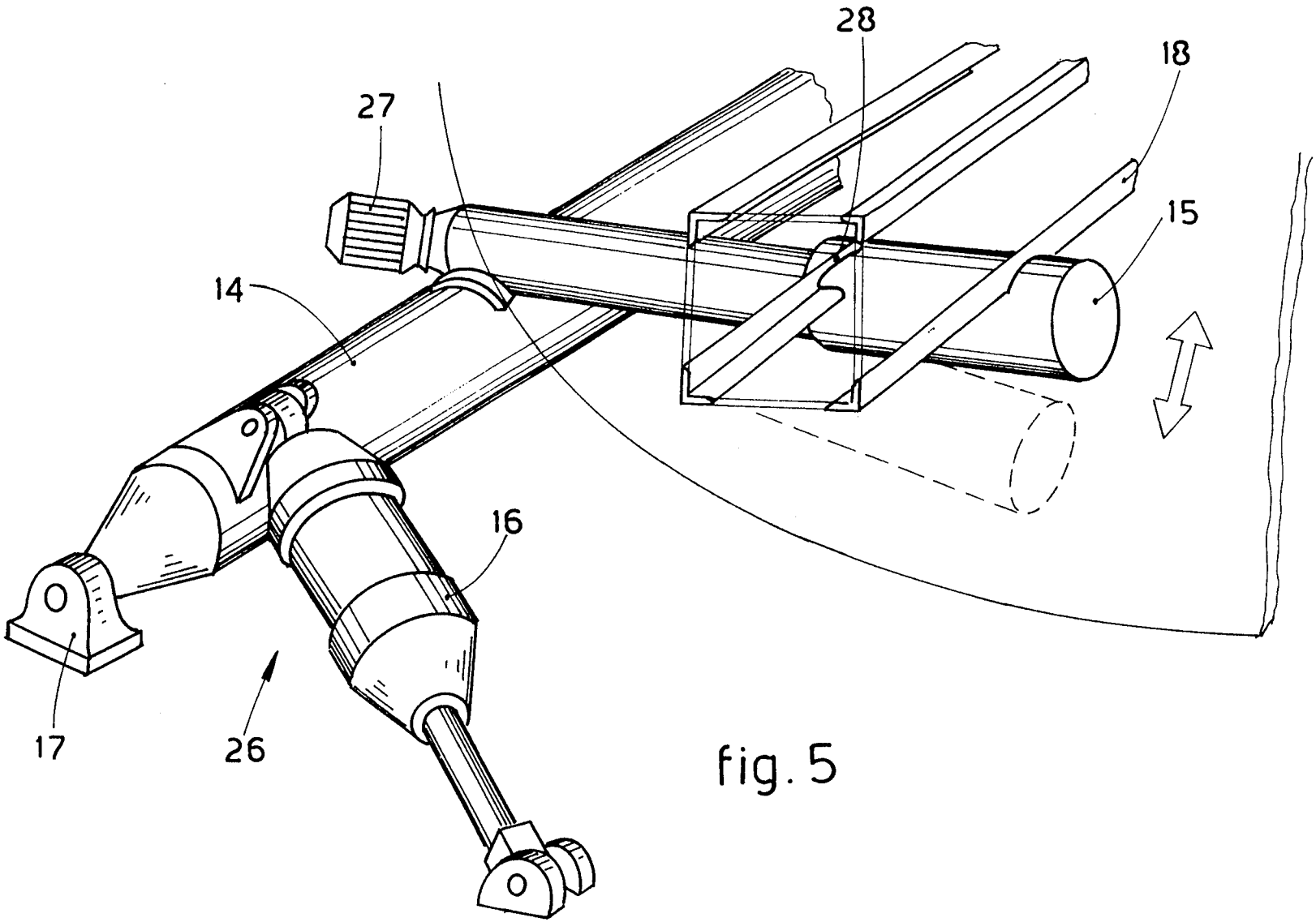

FIG. 4 gives a plan view of the frame that supports and rotates the drum according to the invention;

FIG. 5 shows a three-dimensional view of a detail of the mechanism to withdraw the starter bar belonging to the device according to the invention.

In the figures the reference number 10 indicates generally a starter bar parking device fitted to a vertical (110 - FIG. 1) or curved (210 - FIG. 2) continuous casting plant. In these cases the device shown as an example in both plants serves two casting lines, but the purposes of the invention cover also embodiments suitable for use in cooperation with a number of castings lines other than two.

In particular a form of embodiment of the device 10 is included which is capable of serving three casting lines at the same time.

Figure 1:
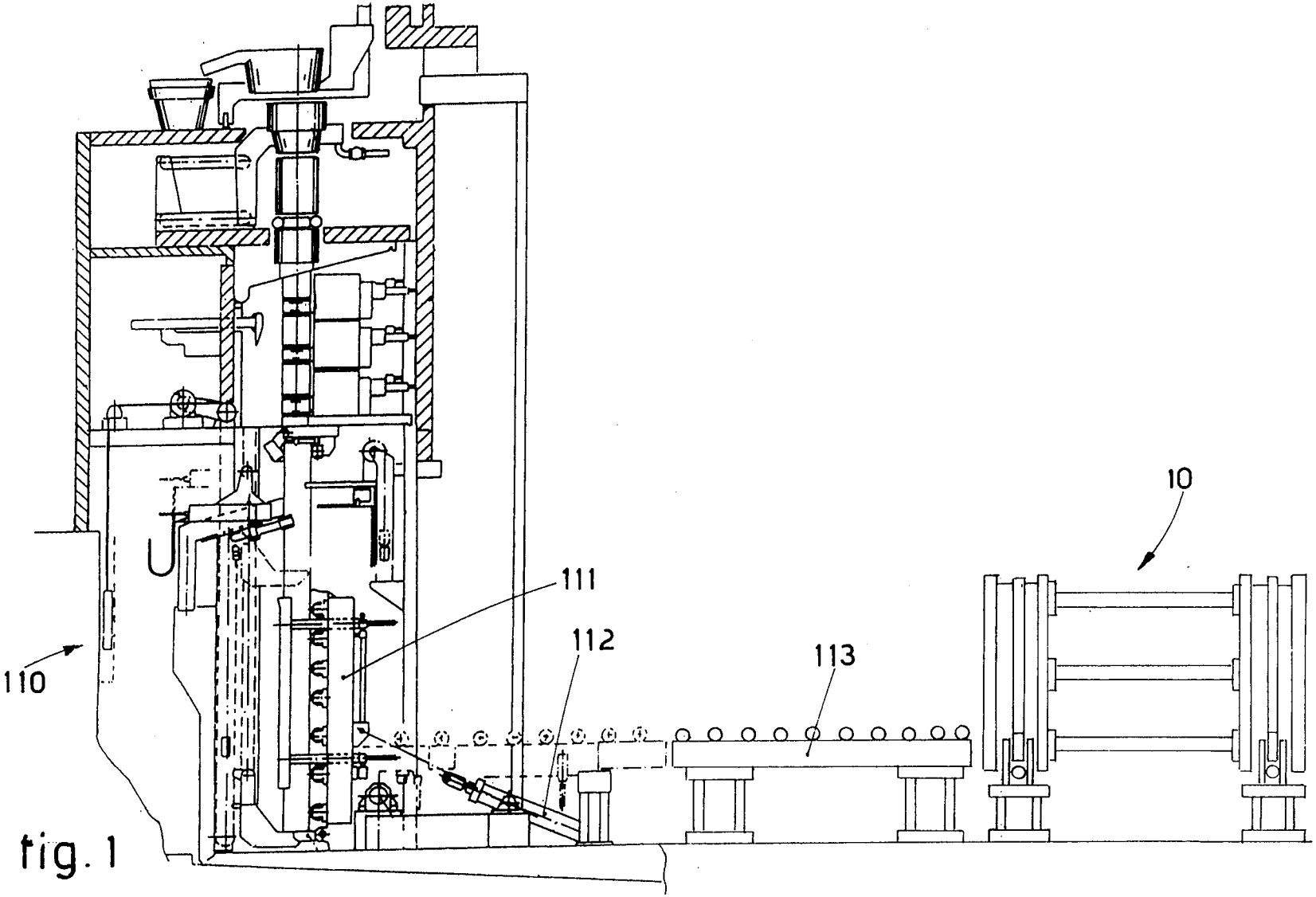
Figure 2:
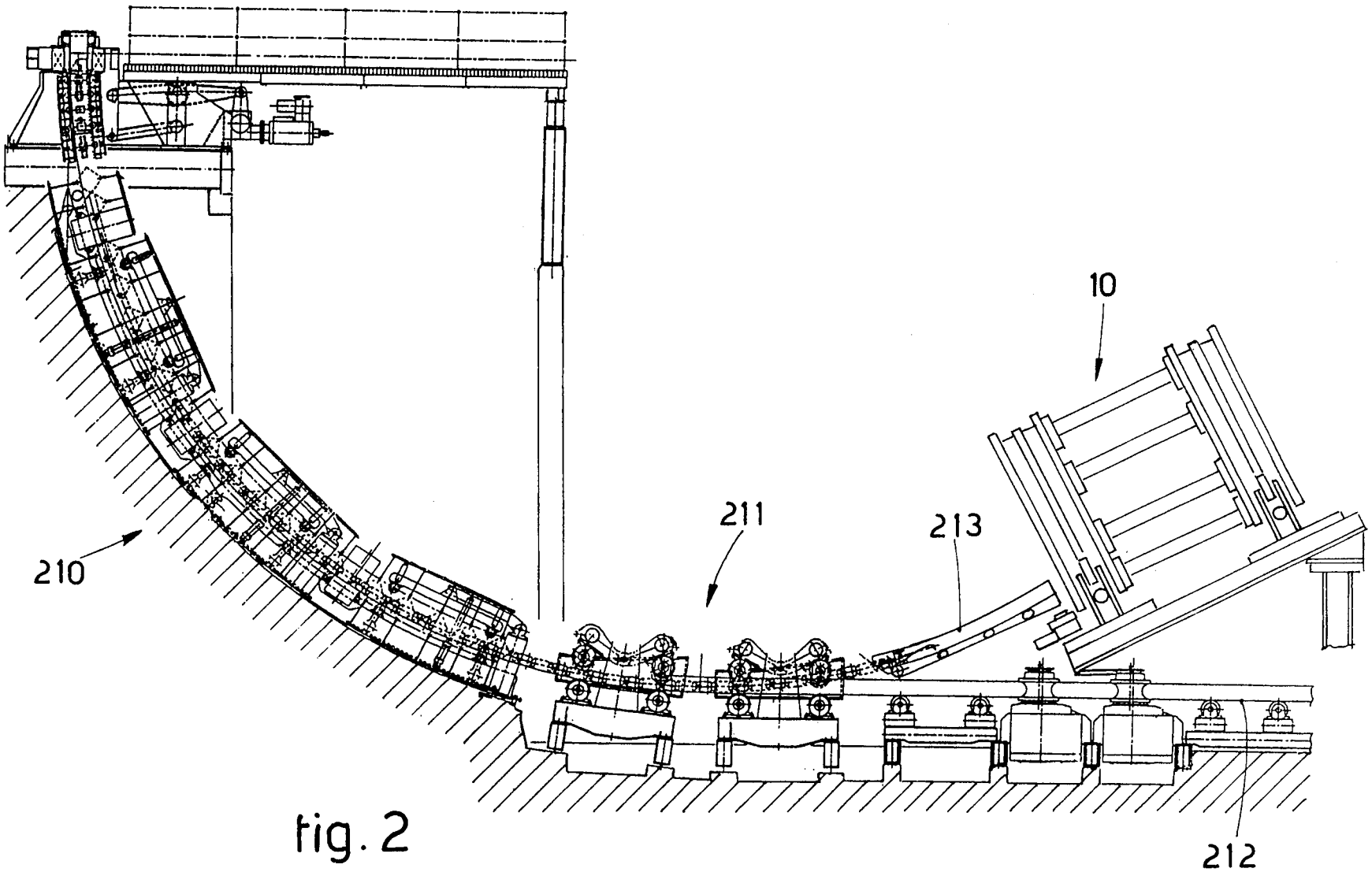
FIG. 2 shows a side view of a curved continuous casting plant equipped with a parking device according to the invention.

FIG. 1 shows that the plant 110 comprises a table 111 capable of being oscillated by a cylinder/piston hydropneumatic actuator 112 and a lateral line 113 for discharge of slabs; at the end of the line 113 is located the parking device 10 in a horizontal position. FIG. 2 shows that the plant 210, which comprises a curved casting line but could provide also for horizontal or almost horizontal casting, comprises a withdrawal and straightening assembly 211 and a lengthwise discharge line 212.

In this case the parking device 10 is located in a raised, tilted position immediately downstream of the withdrawal and straightening assembly 211 and cooperates therewith by means of a conveyor 213.

Instead, where the discharge line 212 acts in a sideways direction, the parking device 10 can be located in a horizontal position at the end of the discharge line 212.

Figure 3:
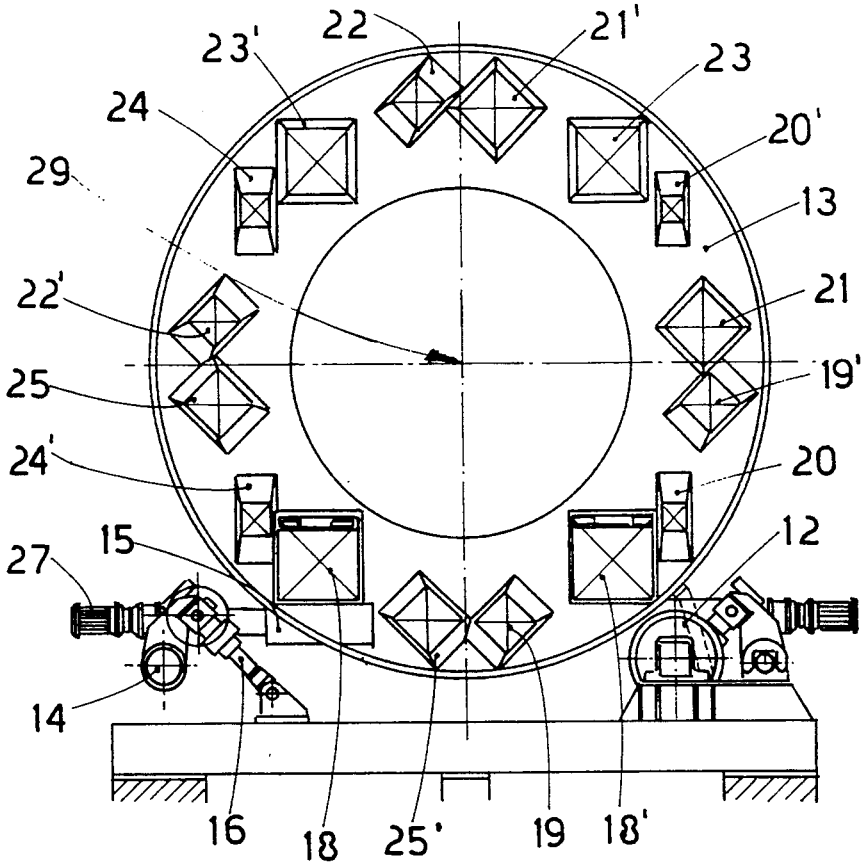
FIG. 3 shows a front view of a revolver drum according to the invention.

In the example shown in FIGS. 3 and 4, the device 10 includes a base plate 11, to which is secured a structure comprising four rollers 12 able to support and set in rotation by means of motors 30 a drum 13 able to rotate about a pivot shaft 29.

Chambers 18-25 to lodge starter bars are arranged within and along the periphery of the drum 13.

FIG. 3 shows an embodiment able to serve at one and the same time two continuous casting lines equipped in a substantially identical manner.

Parking devices 10 may be included which can serve a plurality of casting lines equipped in a different way at one and the same time.

The example given shows eight pairs of respective chambers, 18—18', 19—19', 20—20', 21—21', 22—22', 23—23', 24—24', 25—25'; these pairs of chambers are arranged about the inner periphery of the drum 13 in such a way that they are aligned with two respective casting lines according to the angle of rotation of the drum 13.

In the situation of FIG. 3 the pair of chambers 18—18' is aligned with two casting lines.

Movement of the starter bars from and towards the chambers 18–25 is carried out by a series of mechanisms 26 fixed to the base plate 11 and comprising a support bar 14 and rollers 15 to withdraw and deliver starter bars.

The support bar 14, which in turn is borne on bearings 17, is provided with a movement of rotation (shown in FIG. 5) about its own lengthwise axis by a hydropneumatic cylinder/piston actuator 16 pivoted on the base plate 11. Other known means for rotating the support bar 14 may, of course, be included.

The rotary movement imparted by the cylinder/piston actuator 16 to the support bar 14 causes an oscillation of the withdrawal and delivery rollers 15, each of which is provided with a motor 27, between a first raised position in which the rollers 15 come into contact with the movement of rotation of the drum 13, and a second low position in which the drum 13 can rotate freely.

As can be seen in FIG. 5, the withdrawal and delivery roller 15 in its raised position, shown with full lines in the drawing, becomes inserted into a shaped groove 28 provided in each chamber; in this way the rotation of the drum 13 imparts to the starter bar a movement of delivery into the chamber or of withdrawal from the chamber 18.

The purposes of the invention are therefore achieved since a selective and also simultaneous handling of starter bars of different types and dimensions is made possible according to the casting requirements in plants having many casting lines.

I claim:

1. A device to park starter bars in a continuous casting plant, comprising a revolver-type drum rotatable about a pivot shaft and containing within itself a plurality of chambers to lodge starter bars belonging to at least two types of starter bar; first means for rotating said drum about said pivot shaft whereby a series of chambers can be positioned in alignment with the casting lines according to the circumferential position taken by the drum; and second means for moving at least one starter bar from a casting line into at least one chamber of said plurality of chambers or out from at least one chamber of said plurality of chambers and towards a casting line; said second means being able to cooperate with a temporary pre-set position of standstill of said drum.

2. A device as claimed in claim 1, in which the first means comprises a plurality of rollers driven by motors.

3. A device as claimed in claim 1, in which the second means comprises at least one rotary bar supporting withdrawal and delivery rollers driven by motors, and means for rotating said at least one rotary bar to place the withdrawal and delivery rollers into contact momentarily with a chamber of the revolver drum.

4. A device as claimed in claim 3, in which the means for rotating said at least one support bar is a cylinder/-piston actuator.

5. A device as claimed in claim 1 in which the drum contains a plurality of chambers able to lodge starter bars of different types or dimensions.

6. A device as claimed in claim 5, in which each of the chambers in its position for withdrawal or delivery of a starter bar is aligned with a continuous casting line.

7. A device as claimed in claim 6, which is equipped with a plurality of the chambers and is fitted to a continuous casting plant having at least two casting lines, the device being characterized in that at least some of the chambers are arranged within the drum in such a way that in their position for withdrawal or delivery of starter bars they are aligned with at least two of the casting lines.

8. A device as claimed in claim 1, in which said continuous casting plant is a vertical casting plant or a curved casting plant or a horizontal or sub-horizontal casting plant.

* * * * *